United States Patent [19]

Trame et al.

[11] Patent Number: 5,045,000

[45] Date of Patent: Sep. 3, 1991

[54] NEON SIGN CONNECTOR

[75] Inventors: Charles E. Trame, Mequon; Gary L. Reidenbach, Franklin, both of Wis.

[73] Assignee: Everbrite, Inc., Greenfield, Wis.

[21] Appl. No.: 550,123

[22] Filed: Jul. 9, 1990

[51] Int. Cl.[5] ..... H01R 4/70; H01R 13/44; G09F 13/26

[52] U.S. Cl. ..... 439/892; 40/545; 174/92; 174/138 F

[58] Field of Search ..... 174/5 R, 65 R, 92, 138 F, 174/138 H; 40/545; 248/50; 439/230, 367, 519, 521, 892

[56] References Cited

U.S. PATENT DOCUMENTS 3,992,044 11/1976 Muslin ..... 174/65 R X

FOREIGN PATENT DOCUMENTS 564946 3/1958 Belgium ..... 174/65 R
88899 2/1967 France ..... 174/65 R
982959 2/1965 United Kingdom ..... 174/92

*Primary Examiner*—Laramie E. Askin
*Attorney, Agent, or Firm*—Fuller, Ryan & Hohenfeldt

[57] ABSTRACT

A connector is provided for the conductors running between the electrode-containing ends of a neon tube and the high voltage power supply. Two half-shells composed of rigid insulating plastic are joined together to form a housing after the electrical connection is made between a power supply lead wire and the neon tube to completely enclose the connection. At least one end of the housing resulting from combining the half-shells contains a substantially round hole and a circular groove inwardly thereof. An insulating feedthrough adapter has an integral collar which is captured in the groove. A spirally grooved or corrugated flexible insulating sleeve screws onto the adapter which results in the lead wire being double insulated. One of the end portions of the neon tube fits through a hole in the insulating housing opposite of the hole in which the adapter resides.

5 Claims, 3 Drawing Sheets

NEON SIGN CONNECTOR

BACKGROUND OF THE INVENTION

The invention disclosed herein pertains to display devices such as are commonly known as neon signs. Such signs comprise glass tubes which are bent into various configurations and have electrodes sealed into their opposite ends. The color of the light which is emitted when a high electric potential is applied across the electrodes depends on the particular inert gas with which the tube is filled. Argon, Krypton and Neon are the most commonly used gases, but for the sake of brevity all such light emitting inert gas filled tubes will be called neon tubes herein.

Neon signs customarily comprise frames or panels on which the configured gas filled tube is supported by means of standoffs or insulating supports. Lead wires typically extend from the electrodes through the pinched-off ends of the glass tube and insulated wires which extend from a high voltage power supply are directly connected to the electrode wires and the connections are wrapped with insulating tape or a heat-shrinkable insulating tube. Fine gauge supply wire is used because the current through a neon tube is relatively small, in the milliampere range, but the power supplies have high output voltage. Voltages may range from about 6000 volts to 15,000 volts which, needless to say, produces trauma when voltages at that level are accidentally applied to the human body. The lead wires from the power supply to the neon tube are usually covered with a very flexible insulating material such as rubber having a wall thickness of about 1.5 mm. These signs are often positioned in rather hostile environments which can result in degradation of the wire insulation and unintended contact of the wire by persons.

As a result of the possible hazard of neon signs and the insulating systems that have been proposed for them, no safety organization such as Underwriters Laboratories, Inc. has ever, insofar as applicants are aware, allowed a neon sign design of any manufacturer to carry its certification mark.

SUMMARY OF THE INVENTION

An objective of the invention disclosed herein is to provide a connection for neon signs which would qualify signs for approval by safety testing laboratories such as Underwriters Laboratories, Inc. This objective has been achieved by the invention.

Briefly stated, according to the invention, rigid bodies, called half-shells, are comprised of insulating material which contain elongated cavities. These half-shells are mated in such a way that their corresponding open sides can be superposed on each other or joined to produce a housing wherein the cavities in the half-shells join to form a chamber. There are semi-circular openings in the opposite end portions of each of the half-shell members and they form complete substantially circular openings when the half-shells are joined. There are semi-circular grooves in the half-shells adjacent the semi-circular openings. These grooves form a completely circular groove when the two half-shells are joined. One end of the glass neon tube extends through one of the end openings in the insulating housing. In the opposite end there is an adapter composed of insulating material and which comprises a tubular portion on which there is an integral concentric collar which nests in the substantially circular groove adjacent the end opening in the housing. A flexible insulating sleeve is joined with the tubular portion by turning the sleeve in the manner in which a screw would be turned to advance the sleeve on the tubular portion. The sleeve extends back to the high voltage power supply where it is similarly joined. One of the two high voltage output wires from the power supply extends through the sleeve, the adapter and into the housing chamber for being connected to the lead wire of the tube before the half-shell members are joined. Thus, the wires extending from the power supply to the neon tube are double insulated and, hence, safer and more durable.

How the foregoing and other objectives of the invention are achieved will now be set forth in detail in the ensuing description of a preferred embodiment of the invention in reference to the drawings.

DESCRIPTION OF A PREFERRED EMBODIMENT

Figure 1:
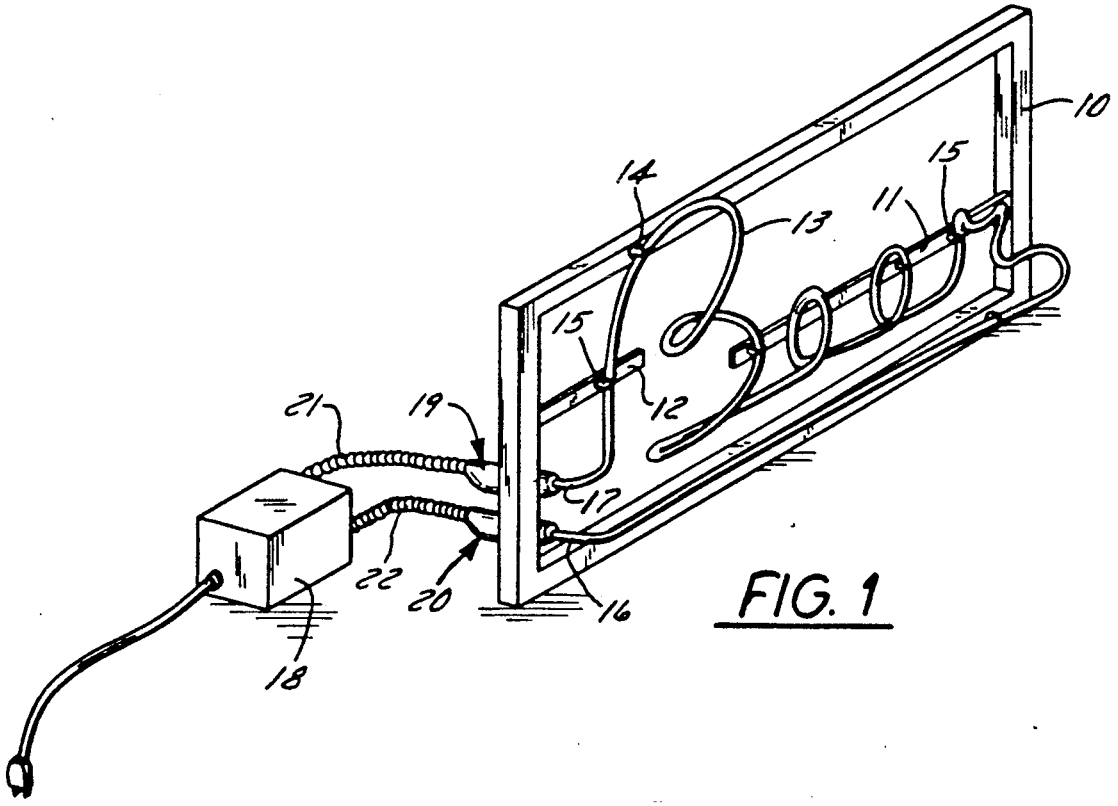
FIG. 1 is a perspective view of a neon sign which is used to illustrate the new insulating system.

FIG. 1 illustrates a neon sign in which the new connector is used. The illustrative sign comprises a rectangular frame 10 on which there are a pair of longitudinally extending support bars 11 and 12. The glass inert gas filled tubing 13 for the sign is formed in a configuration which spells the word BEER. The sign is supported on insulating standoffs or supports such as those marked 14 and 15. Tubing 13 is occupied by one of the inert gases such as neon. Although they are not visible in FIG. 1, within opposite sealed-off ends 16 and 17 of light transmissive tube 13 electrodes are fixed which have lead wires, as will be exhibited later in connection with other figures, extending from them. These electrodes are supplied from a high voltage power supply marked 18. The new connector for the sign includes the two rigid insulating housings 19 and 20 and the insulating helically grooved thin wall sleeves 21 and 22 which are composed of a flexible plastic.

Figure 2:
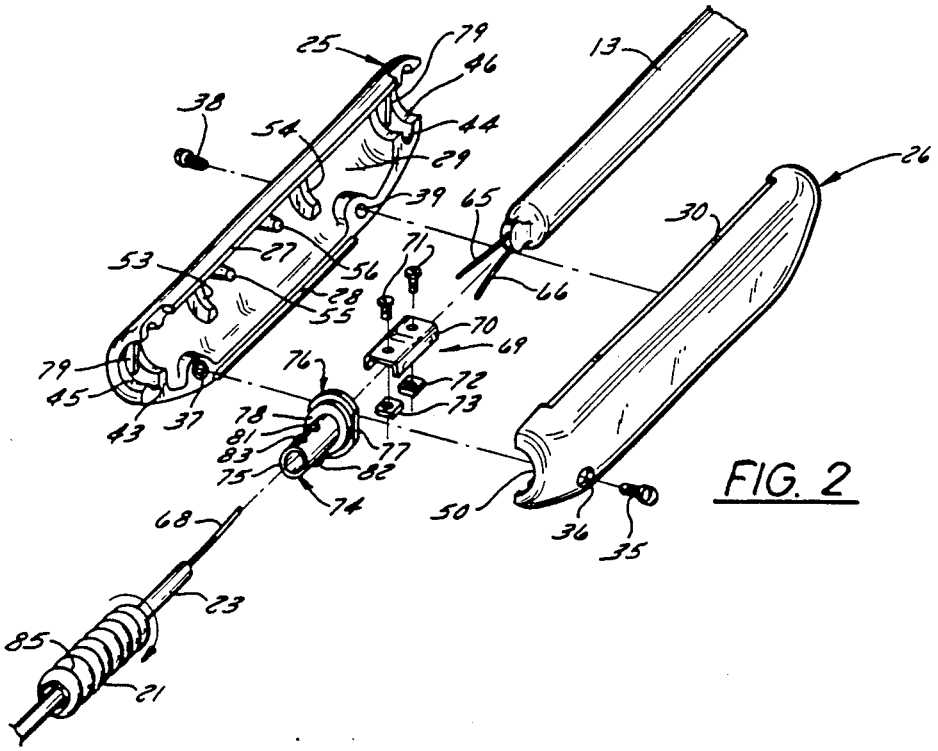
FIG. 2 is an exploded view of the connector showing the glass tube end extending into laterally spaced apart half-shell members and showing other components of the connector arranged between them.

Attention is now invited to the exploded view of the principal elements of the new connector which are depicted in FIG. 2. A typical insulative housing for use on one of the neon tube ends is comprised of the similar half-shell members which are generally designated in FIG. 2 by the numerals 25 and 26. These two half-shell members are designed for mating or joining with each other to form an insulating housing such as either housing 19 or 20 in FIG. 1 for surrounding the place where the electrical connection is made between lead wires extending from the high voltage power supply 18 and the electrodes within the ends of the end portions 16 and 17 of the light transmissive neon tube 13.

Continue referring to FIG. 2 for a more detailed description of one of the half-shell members 25. It comprises two longitudinally extending edges 27 and 28 which form the boundaries of a substantially semi-circular longitudinally extending cavity 29. As can be seen in greater detail in FIGS. 4 and 5, edges 27 and 28 have the configuration of tongues. These tongues register in longitudinally extending grooves 30 and 31 in mating half-shell member 26. When the two half-shell members 25 and 26 are pressed together so that the tongues on half-shell member 25 register in the grooves on half-shell member 26, a rigid insulating housing is formed, such as either one of the housings 19 or 20 in FIG. 1. As is evident in the FIG. 2 exploded view, half-shell members 25 and 26 are clamped together by means of screws such as the one marked 35. This screw passes through a shouldered hole 36 and turns into a metal insert 37. Another screw 38 passes through a shouldered hole 39 in the mating half-shell 25 and enters a threaded insert 40 which is visible in FIG. 6.

Figure 4:
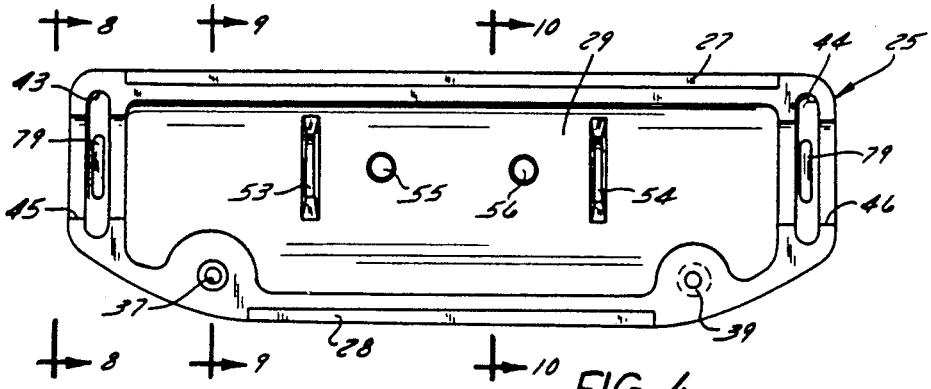
FIG. 4 depicts one of the half-shell members as viewed from its open side and looking into the cavity or recess therein.

Opposite end portions of a typical half-shell insulating member 25 shown in FIG. 4 contain semi-circular grooves 43 and 44. There are also semi-circular openings 45 and 46 in the ends of the half-shell member 25. Corresponding semi-circular grooves 47 and 48 in half-shell member 26 and the semi-circular openings 49 and 50 in the ends of the half-shell member 26 can be seen in FIG. 6. Half-shell member 26 in FIG. 6 must be turned end-for-end and pressed against half-shell member 25 so that the tongues 27 and 28 on member 25 register in the grooves 30 and 31 at the edges of half-shell member 2 to thereby form a housing. When the two half-shell members 25 and 26 are mated, semi-circular openings 45, 50 and 46, 49 join along their diameters to form completely circular end openings in the housing.

Figure 5:
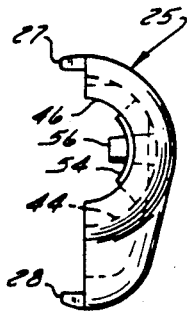
FIG. 5 is a view taken from the right end of the half-shell member depicted in FIG. 4.
Figure 6:
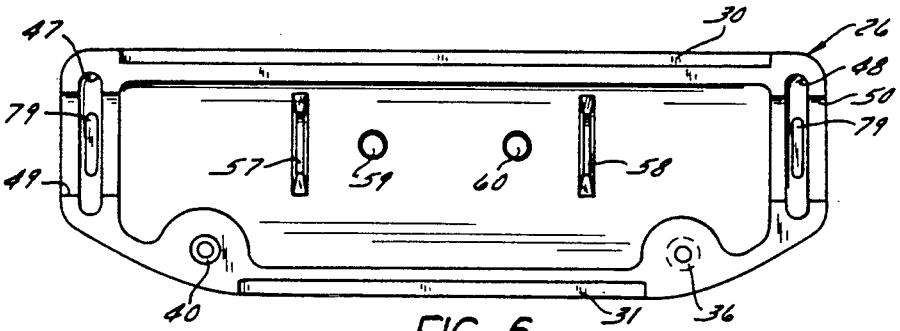
FIG. 6 is a view of a half-shell member, similar to the one depicted in FIG. 4, which would be turned end-for-end and inverted for being superimposed on the member in FIG. 4 for joining them together to form a chamber.
Figure 7:
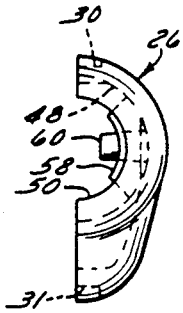
FIG. 7 is a view taken from the right end of the half-shell member depicted in FIG. 6.

As can be seen in several of the figures, half-shell member 25 has some arcuate saddle elements 53 and 54 molded integrally with it. It also contains some integrally molded support pins 55 and 56. There are similar saddle elements 57 and 58 in mating half-shell member 26 and it also contains supporting pins 59 and 60. FIGS. 5 and 7 illustrate how far saddle members 54 and 58 of half-shell members 25, 26, respectively, extend into the semi-circular cavities of the half-shell members.

Incidentally, it will be evident to those skilled in the art that the tongues 27 and 28 need not be on only one of the half-shell members nor do both of the grooves 30 and 31 need to be on the other half-shell member. In other words, as an example, tongue 28 on member 25 could be a groove instead, if a tongue were formed in place of groove 31. The tongues and grooves can be divided in various other ways also.

Figure 8:
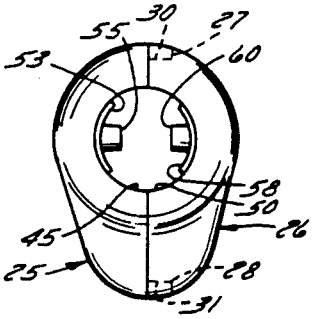
FIG. 8 is an end view in the direction of line 8—8 of FIG. 4 of the half-shell members depicted FIGS. 4 and 6 when they are joined to form a housing but without the conductive leads from the power supply and without an end of a neon tube extending into the housing as would be the case if the assembly were completed.

FIG. 8 shows an end view of the half-shell members 25 and 26 when they are mated and clamped together without the lead wire from the power supply and without an end of the neon tube being inserted. Note that the semi-circular holes 45 and 50 and half-shell members 25 and 26, respectively, now combine with semi-circular holes 46 and 49 in half-shell members 25 and 26, respectively, to form a completely circular end opening in the housing.

Figure 9:
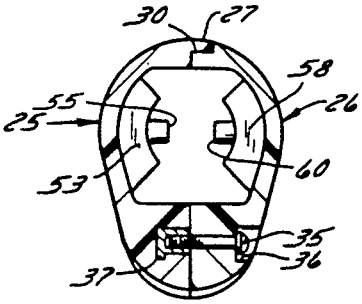
FIG. 9 is a transverse section of one half-shell taken on a line corresponding with 9—9 in FIG. 4 as if the other half-shell depicted in FIG. 6 were joined with it.

FIG. 9 shows how the tongue 27 on half-shell member 25 registers in groove 30 on half-shell member 26.

Figure 3:
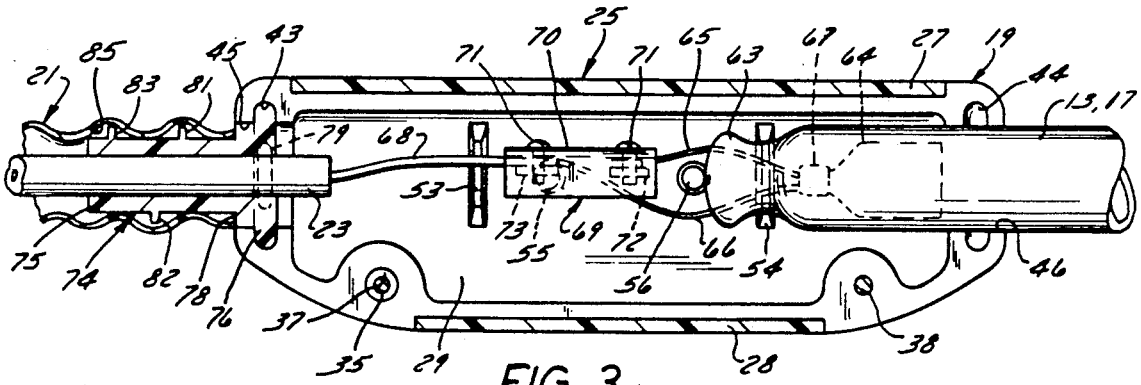
FIG. 3 is a section through the insulating housing defined by the two joined half-shell members and illustrating how one lead wire from the high voltage power supply and the lead wire extending from the pinched-off end of a neon tube into the housing are connected in the housing.
Figure 10:
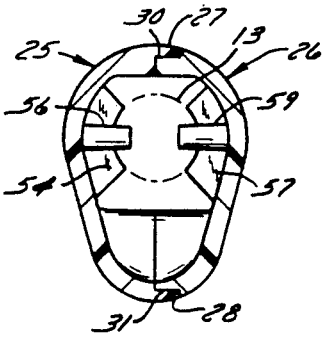
FIG. 10 is a section taken on a line corresponding with 10—10 in FIG. 4.

FIG. 10 shows how the tongues 27 and 28 on half-shell member 25 register in grooves 30 and 31 of half-shell member 26 and this figure also depicts the arrangement of the supporting pins 56, 59 and saddles 54, 57 in another location within the housing. A typical insulating housing assembly, such as the one marked in FIG. 1, is depicted in FIG. 3. This is a longitudinal section of the insulating housing wherein one of the half-shell members 25 is depicted. One end 17 of the gas filled light emissive glass tube 13 is shown residing in the circular end opening 46 of typical insulating housing 19. The end 63 of the glass tube has been pinched off while it was heated so as to seal the end of the tube and develop the essentially duck-bill shape which it has. There is a cylindrical electrode 64 supported in the end of the tube on two lead wires 65 and 66 which are sealed in the pinch-off 63. A single wire would be sufficient for electric conduction purposes but use of the two lead wires provides for stability of the electrode during the sealing process. The ends of the wires are staked in the tip 67 of the electrode.

The two wires 65 and 66 are secured to a connector body which is generally designated by the numeral 69 in FIG. 3 and is shown in greater detail in FIG. 2. The latter figure shows that the connector comprises a channel-shaped body 70 which has clearance holes through which screws marked 71 may pass. There is a nut 72 into which screw 71 turns to clamp wire 65 to the connector body when the screw is tightened into the nut. Electrode wire 66 would ordinarily be similarly clamped under the other nut 73.

FIGS. 2 and 3 depict an insulative feedthrough adapter 74 through which high voltage wire 23, which contains conductor 68, enters the housing comprised of half-shell members 25 and 26. Adapter 74 is comprised of a tubular portion 75 which has a collar 76 formed integrally with it. Collar 76 is mostly circular but it has diametrically opposite flat sides such as the one marked 77 in FIG. 2. There is a circular shoulder 78 integral with collar 76. All of the semi-circular grooves 43, 44, 47 and 48 have a flat boss 79 in them. Thus, in the final joining of half-shell members 25 and 26 to form an insulating housing 19 or 20, the collar 76 of the feedthrough adapter 74 nests in mated semi-circular grooves 43 and 48 of the half-shell members 25 and 26, respectively, and the flat portions 77 of collar 76 become juxtaposed to straight bosses 79 which serve to positively prevent adapter 74 from rotating when the half-shell members are clamped together. Circular shoulder 78 of the adapter registers in the semi-circular end holes 45 and 50 when the half-shell members are clamped together.

The tubular part 75 of feedthrough adapter 74 has radial projections 81–83 which constitute segments of a male thread an have a definite pitch as they would have if they were in a conventional continuous thread. Flexible insulating sleeve 21, which runs from the power supply 18 to the adapter 74, looks like it is simply corrugated but the corrugations are actually formed as a continuous helical thread. When viewed from the inside of the sleeve 21, the corrugations are seen to constitute a continuous helical female thread 85 which has the same pitch as do the thread projections 81–83 on feedthrough adapter 74. Thus, flexible sleeve or shield 21 is screwed onto adapter 74 and a very effective substantially irremovable connection is made between the sleeve 21 and adapter 74. The sequence of assembly operations would involve screwing the adapter 74 into sleeve 21, feeding wire 23 through the sleeve 21 and adapter 74, connecting conductor 68 to connector 69 in one of the half-shell members 25, setting the collar 76 of the adapter 74 in a semi-circular groove 43 and then clamping the second half-shell member 26 to half-shell member 25, assuming the neon tube lead wires 65 and 66 were connected to connector 69 already.

Although it is not visible, an adapter having male thread projections extends out of the power supply 18 and flexible sleeve 21 screws onto it in a manner similar to that in which the sleeve 21 screws onto adapter 74.

Although a preferred embodiment of the new connector has been described in detail, such description is intended to be illustrative rather than limiting, for the invention may be variously embodied and is to be limited only by interpretation of the claims which follow.

We claim:

1. A connector for connecting the bare end of an insulation coated lead wire leading from a neon tube power supply to a lead wire extending from the end of a neon tube, said connector comprising:

two half-shell members composed of insulating material each of which has laterally spaced apart opposite longitudinally extending edges which define the boundaries of a cavity lying between said edges, said half-shell members having opposite longitudinally spaced apart end portions, a generally semi-circular opening in each end portion and a generally semi-circular groove adjacent each opening such that when said two half-shell members are joined together at their edges, the members form a housing containing a chamber made up of the cavities and the semi-circular openings and grooves become contiguous and form substantially circular openings and grooves, respectively, at opposite end portions of said housing, a feedthrough adapter composed of insulating material having a tubular part and a radially extending collar integral with the tubular part, said collar fitting into the substantially semi-circular groove in one end portion of a half-shell member and being secured in the housing by entering the substantially semi-circular groove at the corresponding one end portion of the other half-shell member when the two half-shell members are joined, a flexible sleeve composed of insulating material, said flexible sleeve being adapted to connect to said tubular part of said feedthrough adapter to provide for an insulated wire to pass through the flexible sleeve and through such feedthrough adapter to said chamber in the housing in double insulated fashion so as to present a bare wire end to the interior of the housing, said opening in said other end portion of the housing being for entry of said end of a neon tube into said chamber for the lead wire from a neon tube and a lead wire from the power supply to be connected before said half-shells are joined together, joining said half-shells causing said neon tube to be clamped in the housing, and rigid elements projecting integrally in opposed relationship from each half-shell member inside of said housing for engaging a neon tube between them when the half-shell members are joined together.

2. The connector according to claim 1 wherein said flexible sleeve has a helical groove constituting a thread on its inside coextensive with its length, and said tubular part of said feedthrough adapter has at least one radially extending projection for entering said helical groove and advancing along said thread in response to relative rotation between said adapter and sleeve to secure the sleeve to the adapter.

3. The connector according to claim 1 including connection means for connecting said lead wires from a neon tube and from said power supply before said half-shell members are joined together to form the chamber in the housing.

4. The connector according to claim 1 wherein said semi-circular grooves at the end portions of said half-shell members have flat zones and said collar has corresponding flat zones which coincide with said flat zones of said grooves for preventing rotation of the adapter relative to said housing.

5. The insulating system according to claim 1 wherein the half-shell members are composed of rigid plastic material.

* * * * *